United States Patent [19]

Kubik

[11] Patent Number: 4,972,762

[45] Date of Patent: Nov. 27, 1990

[54] WARM-UP CIRCUIT FOR HYDRAULIC PILOT CONTROL SYSTEM

[76] Inventor: Philip A. Kubik, 1527 Lockridge, Bloomfield Hills, Mich. 48013

[21] Appl. No.: 320,108

[22] Filed: Mar. 6, 1989

[51] Int. Cl.[5] ..... F15B 13/042; F15B 13/043

[52] U.S. Cl. ..... 91/461; 137/625.63

[58] Field of Search ..... 91/461, 304, 431; 137/625.62, 625.63, 625.64

[56] References Cited

U.S. PATENT DOCUMENTS

| | | | |
|---|---|---|---|
| 3,748,967 | 7/1973 | Richter et al. | 91/461 X |
| 3,799,202 | 3/1974 | McAvoy | 91/51 X |
| 3,897,717 | 8/1975 | Kellner | 91/51 |
| 3,921,503 | 11/1975 | Kubik | 91/506 |
| 4,428,400 | 1/1984 | Tantardini | 137/625.61 |
| 4,677,899 | 7/1987 | Schulte et al. | 91/461 X |
| 4,811,650 | 3/1989 | Lonnemo | 91/461 |
| 4,858,649 | 8/1989 | Satoh et al. | 137/625.6 |

FOREIGN PATENT DOCUMENTS

| | | | |
|---|---|---|---|
| 754133 | 8/1980 | U.S.S.R. | 91/461 |
| 503842 | 4/1939 | United Kingdom | 60/445 |

*Primary Examiner*—Edward K. Look
*Assistant Examiner*—George Kapsalas
*Attorney, Agent, or Firm*—Basile and Hanlon

[57] ABSTRACT

A pilot control circuit including a pilot pressure pump and a float center connected directional control pilot valve is provided with a warm up circuit for warming up the hydraulic fluid in the pilot circuit. The warm up circuit includes a pair of branch conduits commonly connected to the high pressure side of the pilot pressure pump and respectively connected via flow restriction to the pilots of a primary directional control valve. Fluid can flow from the branch conduits through the pilots and then through the centered pilot valve to the low pressure side of the pilot pump, allowing a warm up circulation of fluid through the entire pilot circuit while its control valve remains centered.

2 Claims, 1 Drawing Sheet

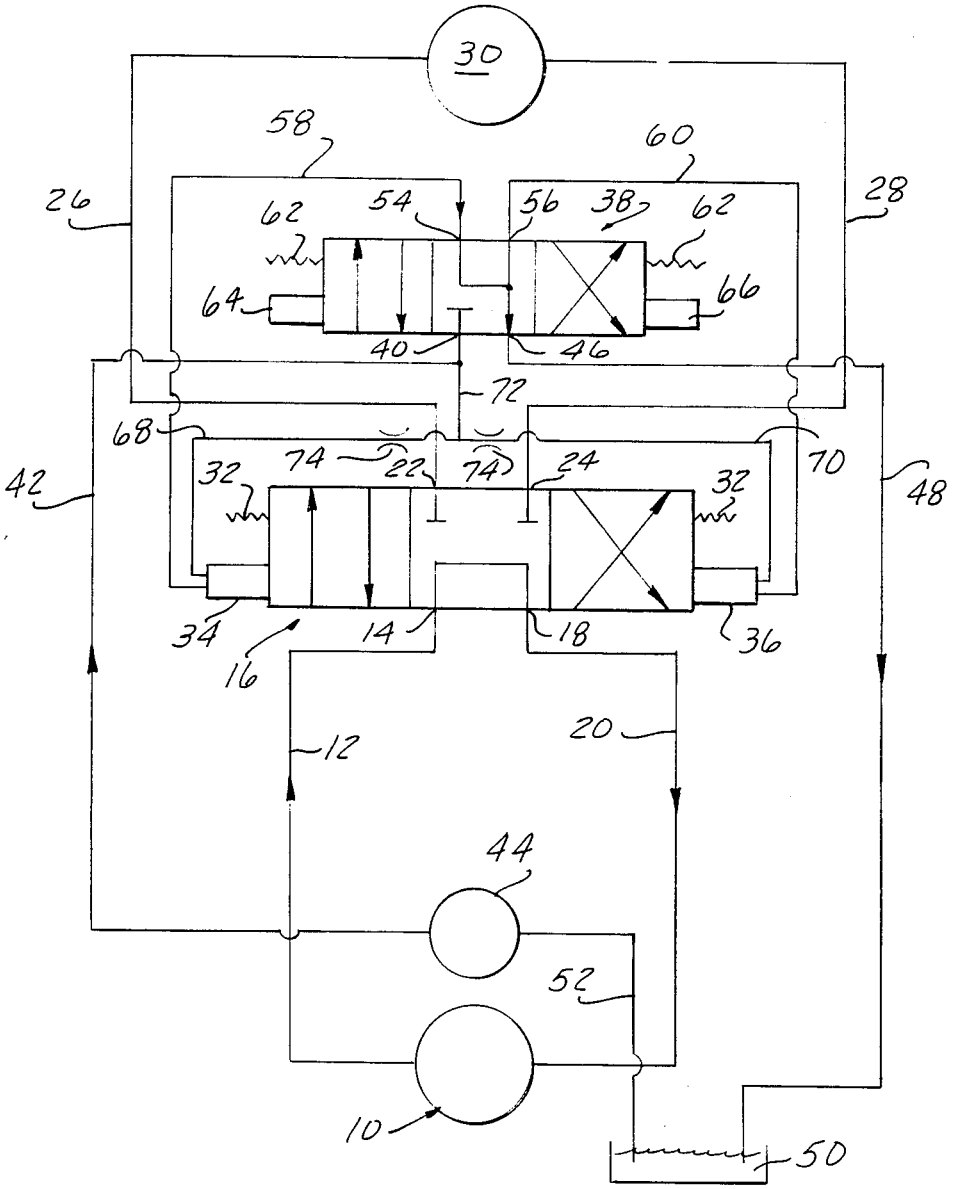
30
58
60
26
28
62
54
56
38
62
64
66
40
46
72
68
70
42
48
32
74
22
74
24
32
34
14
18
36
16
12
20
44
52
10
50

WARM-UP CIRCUIT FOR HYDRAULIC PILOT CONTROL SYSTEM

BACKGROUND OF THE INVENTION:

The present invention is directed to a warm-up circuit by means of which the hydraulic fluid in the control system which supplies operating pressure to the hydraulically actuated pilots of a directional control valve of a primary hydraulic system may be warmed up to a normal operating temperature during the warm-up period for the primary system.

The variation of the viscosity of hydraulic fluids with temperature is such that noticeable differences in the response of hydraulically actuated devices will be observed when comparing the response of the system with the fluid at ambient or room temperature to the response of the system when the hydraulic fluid has reached a normal operating temperature typically 110° F. or higher. It is thus conventional practice where the hydraulic system has been shut down over night to warm up the fluid in the primary system by operating the main system pump for periods of 20 minutes to 1 hour, depending upon the systems, before placing the system in operation. During this warm up period, the directional control valve of the primary system is maintained in its centered position, in which the pressure port of the valve is internally connected to the tank or return port so that fluid from the pump is continuously circulated in a closed loop system or via the tank is an open loop system. The flow of fluid through the hydraulic lines and the pump will raise the temperature of fluid to its normal operating temperature.

Where the directional control valve of the primary system is pilot operated, a problem arises in that the four way directional control valve employed to control the pressure to the pilots of the valve of the primary system is a float center type valve in which, when the valve is in its centered position, both control ports are connected to the tank or return port and the pressure port is blocked. It is thus not possible or practical to attempt to circulate hydraulic fluid in the pilot control circuit to warm this fluid up, and as a result there will normally be a sluggishness in the shifting of the primary system valve until the fluid in the pilot circuit reaches a normal operating temperature. While the slight delay in actuation of the primary system valve due to cold hydraulic fluid in the pilot operating circuit is of little consequence in some applications, it is unacceptable in those applications where the primary hydraulic system is employed to precisely position a tool or work piece because a slight delay in shifting the primary control valve will result in an undesired over travel of the tool or part being positioned.

The present invention is especially directed to a solution to the foregoing problem.

SUMMARY OF THE INVENTION

In accordance with the present invention, a pilot circuit includes a three position four way valve with a float center connection which has its pressure and tank ports connected to its own pump and its control ports respectively connected to the pilots of the primary system directional control valve in a conventional manner. The float center connection of the pilot control valve finds the head spaces of both pilots connected through the centered pilot control valve to the tank or return side of the pilot pressure supplying pump, while the output of that pump is blocked at the pressure port of the pilot control valve. The foregoing connection is conventional and standard and circulation of hydraulic fluid through the pilot circuit cannot occur when the pilot control valve is centered.

To accommodate warm up circulation of hydraulic fluid through the pilot control circuit while the pilot control valve is centered, branch conduits from the head space of each pilot are commonly connected to the pilot pump pressure line, and flow restrictors are provided in each of these branch lines. This connection enables fluid under pressure from the pump to flow through the restrictors in the branch conduits into the head space of the respective pilots, and from the pilot head space to the respective control ports of the pilot control valve. With the float center connection, the fluid flows through the valve from the control ports to the tank port and thence to the sump for the pilot pressure pump in an open loop system. The flow restrictors in the branch lines produce a pressure drop which is somewhat greater than the pressure required to actuate the pilots.

Other objects and features of the invention will become apparent by reference to the following specification and to the drawing.

BRIEF DESCRIPTION OF THE DRAWING

The single FIGURE of drawings is a schematic illustration of a primary and pilot control circuit embodying the present invention.

DETAILED DESCRIPTION OF THE PREFERRED EMBODIMENT

The circuit shown in the drawings includes a main or primary system pump designated generally 10 whose outlet or high pressure side is connected via a high pressure line 12 to the pressure port 14 of a three position four way directional control valve designated generally 16. The tank port 18 of valve 16 is connected via a return line 20 to the intake of main pump 10, while the control ports 22 and 24 of valve 16 are connected via conduits 26 and 28 respectively to a hydraulic motor schematically indicated at 30.

The elements described thus far constitute a closed loop primary circuit in which motor 30 may be driven in either direction or held stationary while pump 10 is operating, depending upon the positioning of the primary directional control valve 16. This arrangement is completely conventional.

Valve 16 is a spring centered pilot actuated valve normally maintained in a centered position by centering springs schematically illustrated at 32 and moveable to either end position by supplying pressure to one of pilots 34 and 36 while connecting the other pilot to a sump or low pressure.

Actuation of pilots 34 and 36 is controlled by a second 3 position four-way directional control valve designated generally 38 whose pressure port 40 is connected by a pressure conduit 42 to the outlet of a pilot pressure supply pump 44. The tank port 46 of valve 38 is connected via a conduit 48 to a sump 50 which supplies the intake of pilot pressure pump 44 via an intake conduit 52. The control ports 54, 56 of valve 38 are respectively connected by conduits 58, 60 to pilots 34, 36 of the primary directional control valve 16. Valve 38 typically is a spring centered solenoid actuated valve normally maintained in the illustrated centered position by springs 62 and shiftable to either end position by actuation of the appropriate solenoid 64, or 66.

The circuit as described thus far is conventional, and its operation is believed apparent. Valve 38, with the illustrated float center connection will when centered connect both control ports 54 and 56, and hence both pilots 34 and 36, to sump 50 so that no pressure is applied to either pilot and primary valve 16 will be maintained in its illustrated center position by its centering springs 32.

With the two valves in the positions shown, operation of primary pump 10 will continuously circulate primary circuit fluid from the pump through pressure line 12 to port 14, thence through the valve to tank port 18 and back to the intake side of pump 10 via conduit 20. Continuous circulation of fluid through this last circuit while pump 10 is idling will warm up the fluid in that circuit.

However, with the pilot pressure control valve 38 in its centered position, fluid under pressure from the outlet side of pilot pressure pump 44 is blocked at pressure port 40 of valve 38, hence a warm up circulation of fluid through the pilot control circuit normally could not occur.

To accommodate warm up circulation through the pilot circuit, a pair of branch conduits 68, 70 are commonly connected via a conduit 72 to pressure line 42 which is connected to the outlet side of pilot pressure pump 44. With valve 38 in the centered position shown, fluid under pressure from pump 44 which passes through line 42 cannot enter pressure port 40 of value 38, but can flow through conduit 72 and thence through branch conduits 68, 70 into pilots 34, 36, the fluid flowing through conduits 68 and 70 passing through flow restrictors 74 located in each of lines 68 and 70. Fluid from lines 68 and 70 flows into the respective pilots 34, 36 and then from the pilots via lines 58, 60 to control ports 54, 56 of valve 38 and thence through the centered valve to sump conduit 48 and into sump 50. Hydraulic fluid from pump 44 may thus be continuously recirculated through the entire pilot circuit to warm up this fluid prior to placing the primary circuit in operation.

The restriction to flow of fluid through branch conduits 68 and 70 imposed by restrictors 74 creates a pressure drop across the restrictors which is somewhat greater than the pressure required to actuate the pilots 34, 36. Thus, when pilot valve 38 is shifted to either of its end positions, the restrictors provide a sufficient resistance to the flow of fluid through branch conduits 68, 70 so that sufficient pressure is developed in conduit 58 and 60 to actuate the pilot connected to the line.

While one embodiment of the invention has been described in detail, it will be apparent to those skilled in the art that the disclosed embodiment may be modified. Therefore, the foregoing description is to be considered exemplary rather than limiting, and the true scope of the invention is that defined in the following claims.

I claim:

1. In a hydraulic circuit for controlling the operation of a first four way directional control valve having a pair of opposed hydraulically actuated pilots for shifting the first valve between a neutral, a forward and a reverse position, said circuit including a second three position four way directional pilot control valve operable in respective first and second off center positions to actuate said pilots to shift said first valve to said forward and reverse positions and normally maintained in a neutral centered position, pump means having an output pressure line connected to a pressure port of said second valve and a return line connected to a return port of said second valve, said second valve having first and second control ports respectively hydraulically connected to the pilots of said first valve, and means in said second valve blocking said pressure port and connecting said return port to both of said first and second control ports when said second valve is in said centered position;

The improvement comprising first conduit means hydraulically connecting said pressure line at all times to both of said pilots, and flow restriction means in said first conduit means.

2. The invention defined in claim 1 wherein said first conduit means incudes a pair of branch conduits respectively connected to said pilots and commonly connected to said pressure line, and a flow restrictor in each of said branch lines.

* * * * *